US005441008A

United States Patent [19]

Lange

[11] Patent Number: 5,441,008

[45] Date of Patent: Aug. 15, 1995

[54] SUBMERGED SWIVELLING MOORING LINE FAIRLEAD DEVICE FOR USE ON A STRUCTURE AT SEA

[75] Inventor: Espen Lange, Oslo, Norway

[73] Assignee: Kvaerner Engineering a.s., Lysaker, Norway

[21] Appl. No.: 157,214

[22] Filed: Nov. 24, 1993

[51] Int. Cl.[6] ..... B63B 21/24
[52] U.S. Cl. ..... 114/293; 114/179
[58] Field of Search ..... 114/293, 294, 179

[56] References Cited

FOREIGN PATENT DOCUMENTS 2594406 8/1987 France ..... 114/293

*Primary Examiner*—Jesus D. Sotelo
*Attorney, Agent, or Firm*—Young & Thompson

[57] ABSTRACT

A submerged fairlead for a mooring line for use on a structure at sea is rotatably mounted in a swivelling elongated rigid tube mounted on the structure and through which the mooring line passes, and the free end of which is equipped with a line stopper. The tube is several meters in length. It causes direct transfer of the mooring forces to the structure when the line stopper is activated.

2 Claims, 1 Drawing Sheet

SUBMERGED SWIVELLING MOORING LINE FAIRLEAD DEVICE FOR USE ON A STRUCTURE AT SEA

FIELD OF THE INVENTION

The invention relates to a submerged swivelling mooring line fairlead device for use on a structure at sea.

The invention has been especially developed in connection with mooring systems for so-called floaters, such as a moored floating drilling platform, but is not restricted exclusively to such utilization, as it can be used anywhere where similar problems arise when mooring structures at sea.

For instance, in the case of a so-called semi-submersible drilling platform, mooring lines extend from the sea-bed to swivelling fairleads which are positioned under water, usually on the floats. A single mooring line extends from the fairlead to the hauling device with accompanying cable stopper. The relative motions between the mooring line and the moored structure result in hard wear on the line. This is due to the fact that the relative motions are absorbed by the line. If the mooring line is a chain, the links in the chain will chafe against one another because the chain is subjected to twisting. Moreover, in the conventional device, the mooring forces will be guided towards the mooring winch which gives rise to a resultant force on the submerged swivelling fairlead which is greater than the line load. This causes extra wear-induced stress on the line.

SUMMARY OF THE INVENTION

According to the invention, one objective is to provide a device of the type described by way of introduction wherein all relative motion between the mooring line and the structure will be absorbed by swivel bearings and not directly by the line. A further objective is to be able to lead all forces directly into the structure by means of the submerged swivel mount.

According to the invention, a submerged swivelling mooring line fairlead device for use on a structure at sea is therefore proposed, characterized in that the fairlead is rotatably mounted on a swivelling elongated rigid body mounted on the structure, the free end of said elongated rigid body being equipped with a line stopper.

A device of this kind gives rise to several advantages. When the mooring line is tensioned by means of the mooring winch, it is locked by the line stopper, thereby establishing a longer rigid connection leading to the swivel bearing on the structure. This means that all relative motion between the line and the structure will be absorbed by the swivel bearing. Since the forces are led directly into the structure, the great resultant force which occurs with conventional embodiments is avoided. The device will be sensitive to deviation since only slight deviation between the mooring line and the elongated rigid body will give sufficient moment to cause movement in the swivel bearing. The mooring line therefore needs only to exert a slight moment on the body to cause movement in the swivel bearing.

The mooring line stopper may be of the active or passive type.

The line stopper may be a chain stopper. In this case, at least the portion or part of the mooring line which is to be stopped must be a length of chain.

It would be of advantageous if the elongated rigid body were to be a tubular body through which the mooring line passes.

The fairlead may be a cable sheave or a chain sheave, depending upon the preferred design of the mooring line. The mooring line may be made up of a part that is purely cable or wire from the mooring winch and down past the fairlead, where an anchor chain is connected. Other embodiments are also possible such as the entire mooring line being of chain, or portions of the mooring line being cable whilst other portions are chain or lengths of chain, and so forth.

The invention, as mentioned, has been developed primarily in connection with semi-submersible offshore platforms, but may, of course, be used for floaters in general, for instance regular vessels, and also for more fixed installations which require mooring lines, for example, articulated columns.

BRIEF DESCRIPTION OF THE DRAWINGS

The invention shall now be described in more detail with reference to the drawings, where.

DETAILED DESCRIPTION OF THE INVENTION

Figure 1:
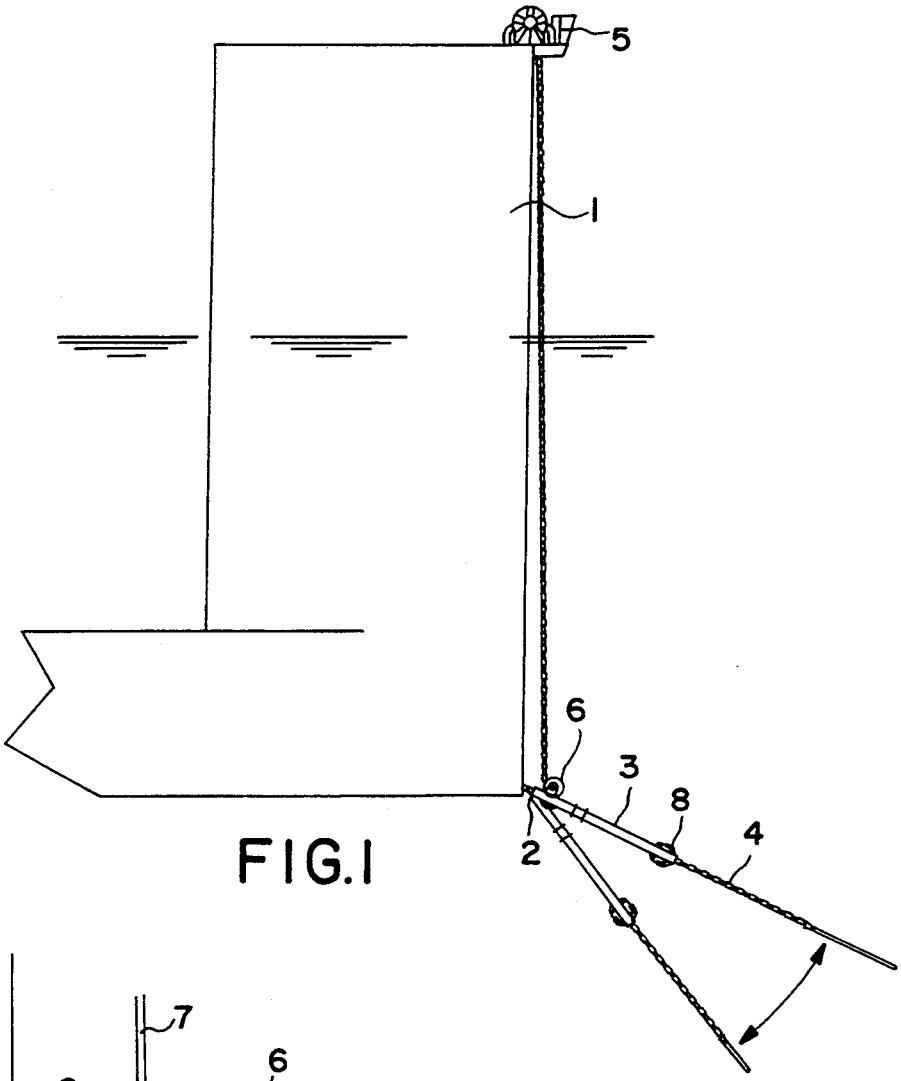
FIG. 1 is a schematic section of a floater with a device according to the invention.

In FIG. 1 a section of a floater 1 is shown. In a submerged state, a swivel 2 is mounted on the floater and forms a swivel bearing for a tube 3. A mooring line 4 passes through the tube 3 and up along the floater 1 via a fairlead 6 rotatably mounted on the tube 3. The mooring line, here indicated as a chain, extends to a mooring winch 5 on the deck of the floater. A cable stopper 8 is positioned outermost on the tube 3, here in the form of a chain stopper, because the mooring line in this part is chain. The double arrow is used to indicate how the tube 3 can pivot in the vertical plane around a swivel connection 2. The swivel connection is such that the tube can also pivot in the horizontal plane. The swivel connection is thus a universal joint.

Figure 2:
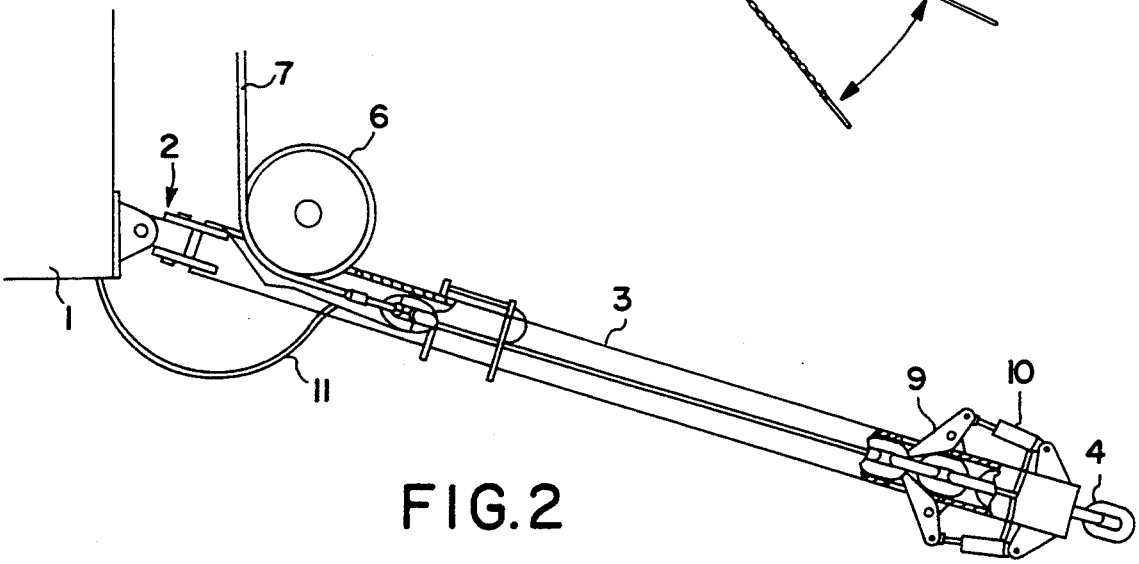
FIG. 2 is an sectional elevation of a device according to the invention.

FIG. 2 is a more detailed illustration of the tube 3 and accessories. A modification has been made so that instead of a fairlead designed for a chain, a fairlead 6 is used that is suitable for a cable 7 which forms a part of the mooring line. Thus the cable 7, as shown in FIG. 2, is connected to a length of chain 4. The chain stopper 8, as shown in FIG. 2, is designed with stopper claws 9 rotatably mounted in brackets which by means of hydraulic cylinders 10 can be brought in and out of stopper engagement with the chain 4. The hydraulic cylinders 10 are supplied with hydraulic oil via the indicated pipe 11.

When the mooring line is locked, as shown in FIG. 2, the forces will be transmitted directly via the tube 3 to the floater 1 in the swivel connection 2. Motions between mooring line and floater will therefore not cause any twisting in the mooring line or cable. Nor will the resultant force at the sheave 6 have any effect on the mooring line, as it is tensioned at the stopper 8 and that is where the transmission of forces to the floater 1 occurs via the tube 3.

The chain stopper that is used is of the active type, i.e., one which can be used positively for stopper interaction as well as release. Other stopper types may of course be used, also those of a more passive type, i.e., for instance a type with claws which merely latch into place and require special measures for release.

In the area where locking interaction with the stopper is to be achieved, it would be advantageous if the mooring line were a chain because true form interaction would occur between the chain and the stopper claws. However, the mooring line could optionally be a cable in this area, and it would then have to be provided with a suitable stopper device which grips the cable as required.

The tube 3 should be of a certain length. A length of from 10 to 20 meters is recommended as this will give excellent deviation, i.e., that only a slight deviation between the mooring line and the tube will give sufficient moment to cause movement in the swivel bearing. When being hauled up the mooring line will only subject the tube to a slight moment relative to the cable tension and the moment of the cable weight on the tube.

I claim:

1. Submerged swivel mounted fairlead device comprising: a fairlead and a rigid guide extending from the fairlead towards an anchor, said rigid guide having a stopper means for stopping an anchor cable lead around the fairlead and through said guide, said guide being a tube body connected to a swivel mount for mooring of a structure at sea, said fairlead being rotationally mounted in the tube body outside of the swivel mount wherein the connection between said rigid guide and said swivel mount is constructed and arranged for taking up of tension force in said anchor cable, and said stopper means being adapted to be activated during mooring.

2. Submerged swivel mounted fairlead device as in claim 1, wherein the stopper means includes means for positively stopping and releasing the anchor cable.

* * * * *